United States Patent [19]

Chapman et al.

[11] 4,034,214

[45] July 5, 1977

[54] MULTIPLE POSITION LAMP

[76] Inventors: Earle F. Chapman, Summer St., Marshfield, Mass. 02051; Bernard J. Ruskin, 17 Sheldon Road, Marblehead, Mass. 01945

[22] Filed: Mar. 4, 1976

[21] Appl. No.: 663,972

[52] U.S. Cl. ..... 240/70; 240/81 BD

[51] Int. Cl.[2] ..... F21S 1/12; F21S 3/10

[58] Field of Search ..... 240/81 BS, 81 BC, 81 BD, 240/70, 81 R

[56] References Cited

UNITED STATES PATENTS

| | | | |
|---|---|---|---|
| 1,889,978 | 12/1932 | Dickey | 240/81 BD |
| 2,466,176 | 4/1949 | Kunisch | 240/81 BS X |
| 3,012,801 | 12/1961 | Cole | 240/81 R X |
| 3,186,736 | 6/1965 | Warshawsky | 174/86 X |
| 3,694,647 | 9/1972 | Chapman et al. | 240/81 R |
| 3,955,079 | 5/1976 | Chapman et al. | 240/81 BC X |

*Primary Examiner*—L. T. Hix
*Assistant Examiner*—Michael L. Gellner
*Attorney, Agent, or Firm*—Morse, Altman, Oates & Bello

[57] ABSTRACT

A floor lamp with a pair of rotatable tubular members defining a vertically extendable telescopic body. The larger tubular member is provided with an internal longitudinal rib. A pair of pins project from an exterior surface of the smaller tubular member at one side thereof, the ends of the pins out of contact with the interior surface of the larger tubular member. A cylindrical guide formed with a longitudinal slot is captively held between the projecting pins, the rib received within the slot. As the smaller tubular member is rotated relative to the larger tubular member, the pins engage the rib and limit rotational movement to less than one complete revolution.

11 Claims, 8 Drawing Figures

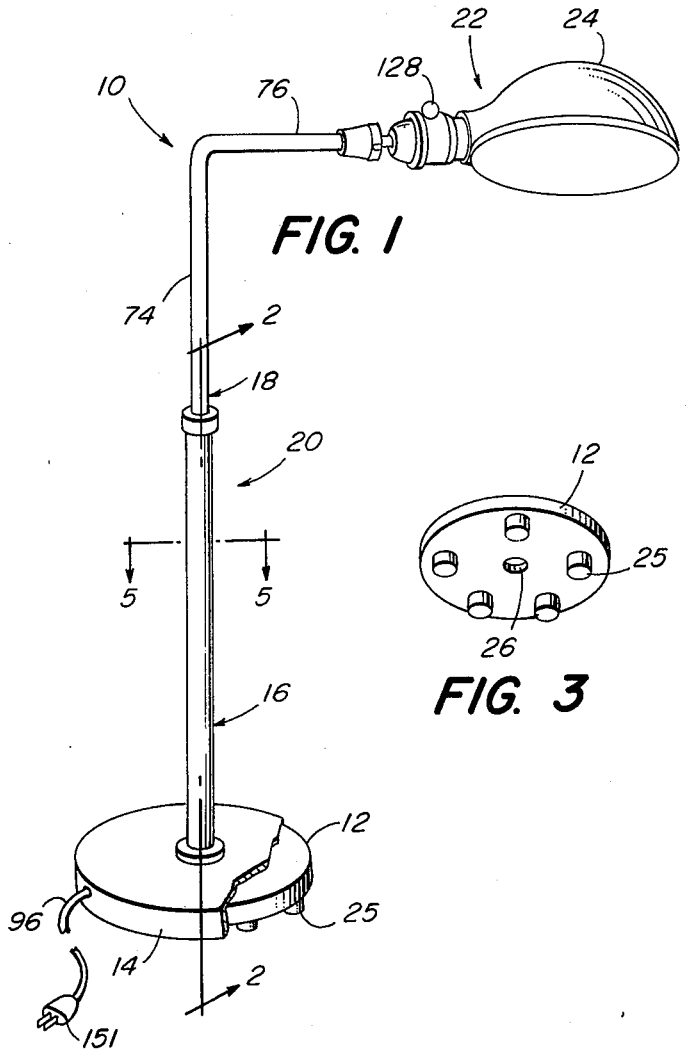
FIG. 1
FIG. 3
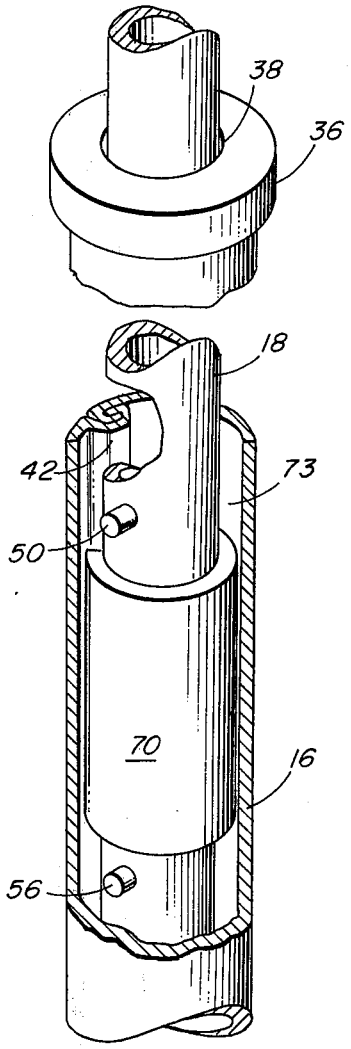
FIG. 4
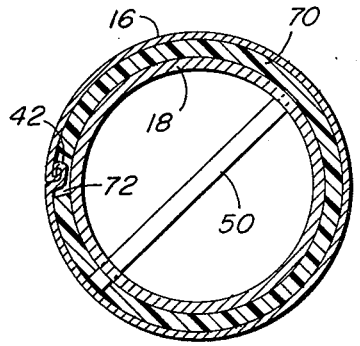
FIG. 5
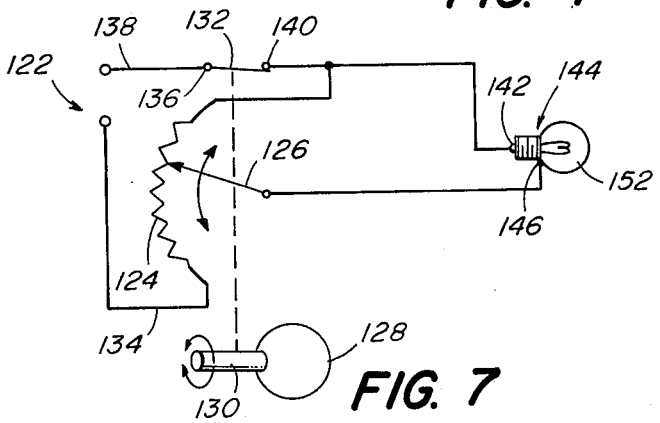
FIG. 7

MULTIPLE POSITION LAMP

BACKGROUND OF THE INVENTION

1. Field of Invention

The present invention relates to lighting fixtures and, more particularly to multiple position floor lamps.

2. Description of the Prior Art

The intensity and orientation of a light source is of key importance in minimizing eye strain, especially when a person is reading or studying for extended periods of time. Floor lamps have been designed with rotatable telescopic bodies which provide both vertical and rotational adjustment. Such lamps have suffered from the disadvantage that continued rotation of the telescopic body has resulted in premature failure of the internal wiring due to twisting.

SUMMARY OF THE INVENTION

It is an object of the present invention to provide a floor lamp having a telescopic body that is vertically extendable and is rotatable less than one complete revolution. The lamp includes a pair of rotatable tubular members that constitute the telescopic body. The larger tubular member is secured to a base and a receptacle is connected to the smaller tubular member. The larger tubular member is fixed against rotation and the smaller tubular member is vertically and rotatably adjustable within the larger tubular member. A pair of pins project perpendicularly from an exterior surface of the smaller tubular member in spaced parallel alignment out of contact with an interior surface of the larger tubular member. A longitudinal rib is provided at the interior surface of the larger tubular member for engagement with the pins as the smaller tubular member is rotated. A cylindrical guide formed with a slot configured to receive the rib is captively held about the smaller tubular member between the pins. As the smaller tubular member is rotated relative to the larger tubular member, the pins contact the rib and limit rotational movement to less than one complete revolution.

Other objects of the present invention will in part be obvious and will in part appear hereinafter.

The invention accordingly comprises the apparatuses, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein:

FIG. 1 is a perspective view of a floor lamp embodying the invention;

FIG. 3 is a perspective view of the floor lamp base;

FIG. 4 is a fragmentary perspective view illustrating the telescopic body of FIG. 1;

FIG. 5 is a sectional view taken along the lines 4—4 of FIG. 1;

FIG. 7 is a schematic diagram of the variable impedance circuit of the receptacle.

DETAILED DESCRIPTION OF THE PREFERRED EMBODIMENTS

Figure 2:
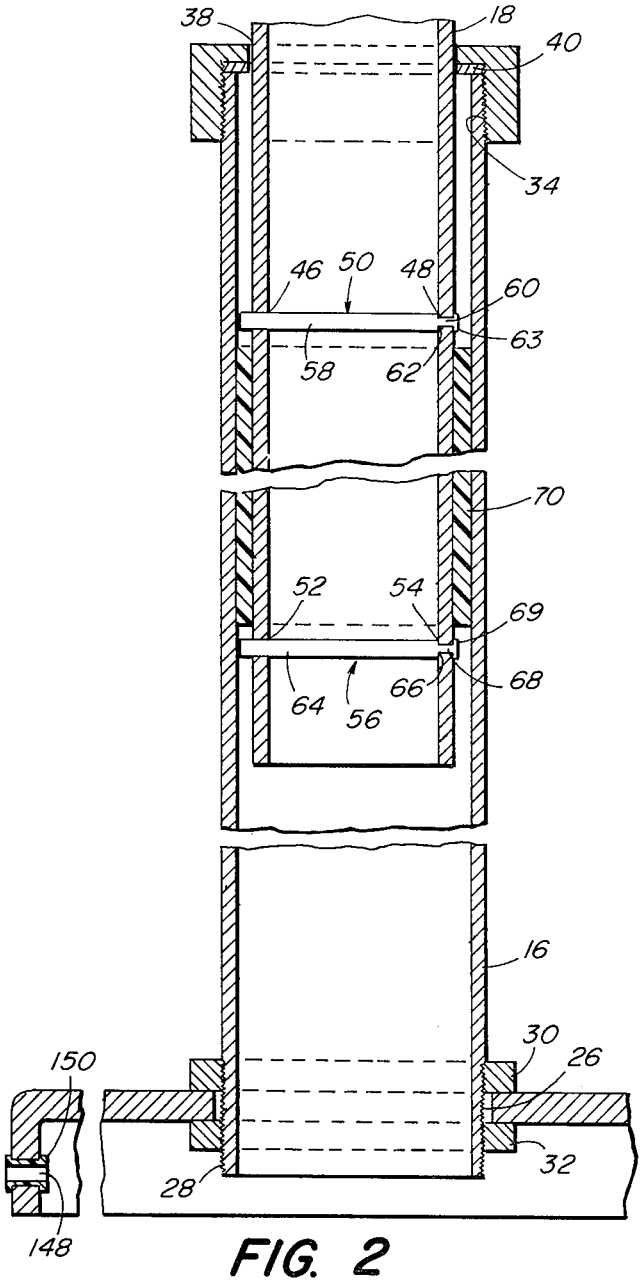
FIG. 2 is a sectional view taken along the lines 2—2 of FIG. 1.

Referring now to the drawings, particularly FIG. 1, there is shown a floor lamp 10 embodying the invention. Lamp 10 comprises a circular base 12 having an annular skirt 14, a pair of tubular members 16, 18 defining a telescopic body 20, and a lamp receptacle 22 with a shade 24. As shown in FIG. 3, base 12, for example a weighted base having extending feet 25, is formed with a concentric through hole 26 which is adapted to receive a threaded end 28 of tubular member 16. Feet 25, for example five feet spaced equally about the periphery of base 12, are operative to stabilize floor lamp 10, particularly when positioned on carpets. Internally threaded rings 30 and 32 are turned onto threaded end 28 at opposite faces of base 12. Hole 26 is slightly larger than threaded end 28 and smaller than rings 30 and 32, whereby tubular member 16 is secured to base 12 by the vise-like grip of rings 30 and 32 on opposite faces of the base. The other end of tubular member 16 is threaded as shown at 34 in FIG. 2. An internally threaded cap 36 formed with a concentric through hole 38 is threaded onto end 34. A fabric washer 40 is interposed between the end 34 and an interior shoulder of cap 36. Tubular member 18, the smaller of tubular members 16, 18, is slidably received within concentric opening 38 and tubular member 16. As hereinafter described, tubular member 18 is rotatably and vertically slidable relative to tubular member 16.

Figure 8:
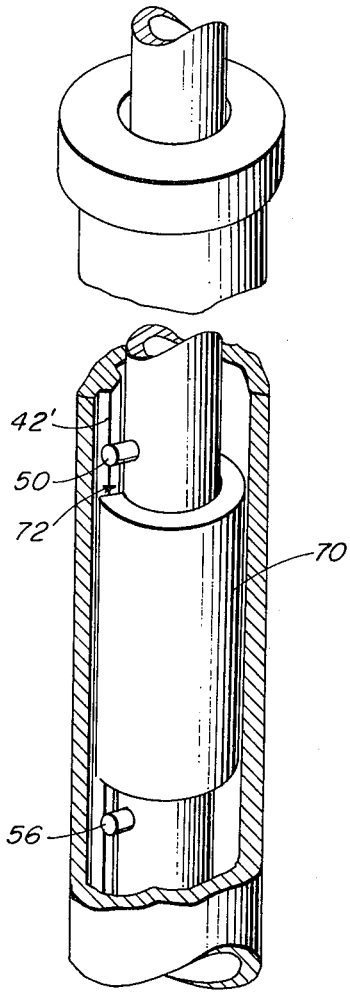
FIG. 8 is a fragmentary perspective view of an alternative embodiment of the invention.

In the illustrated embodiment of FIG. 4, tubular member 16 is composed of a flat sheet of metal such as aluminum or bronze, that is rolled into a tubular structure having a longitudinal rib 42 formed by interlocking the edges of the sheet. In an alternative embodiment, as shown in FIG. 8, tubular member 16 is an extruded tube that is formed with a longitudinal rib.

Tubular member 18 is formed with a pair of through holes 46 and 48 that are configured to receive a pin 50 and a pair of through holes 52 and 54 that are configured to receive a pin 50 and a pair of through holes 52 and 54 that are configured to receive a pin 56. Hole 46 is diametrically opposite hole 48. Pin 50 has an enlarged cylindrical body 58 and a narrowed cylindrical end 60, a shoulder 62 formed between the enlarged body and the narrow end. Cylindrical body 58 is snugly received in hole 46 and narrowed end 60 is snugly received in hole 48, the diameter of hole 48 being smaller than the diameter of body 58. Shoulder 62 is pressed against the interior surface of tubular member 18 and narrowed end 60 is flatened at the exterior surface of tubular member 18 to form a head 63 for captively holding pin 50. Pin 56 has an enlarged cylindrical body 64 and a narrowed cylindrical end 66, a shoulder 68 formed between the enlarged body and the narrow end. Cylindrical body 64 is snugly received in hole 52 and narrow end 66 is snugly received in hole 54, the diameter of hole 54 being smaller than the diameter of body 64. Shoulder 68 is pressed against the interior surface of tubular member 18 and narrow end 66 is flatened to form a head 69 at the exterior surface of tubular member 18 for captively holding pin 56. Pins 50 and 56 are substantially perpendicular to the longitudinal axis of tubular member 18 and in spaced parallel alignment with one another. The enlarged body portion of each pin 50 and 56 extends outwardly from the exterior surface of tubular member 18 out of contact with the interior surface of tubular member 16. Rib 42 extends outwardly from the interior surface of tubular member 16 a sufficient amount so as to engage pins 50 and 56 when tubular member 18 is rotated. A cylindrical guide 70 formed with a longitudinal slot 72 that extends the length of the guide is captively held about tubular member 18 in an annular chamber 73 formed between tubular members 16 and 18. Guide 70, which is composed of a plastic such as a linear polyamide resin, has an inside diameter which is slightly larger than the outside diameter of tubular member 18 and has an outside diameter which is slightly smaller than the inside diameter of tubular member 16. The length of guide 70 is approximately 2.5 cm and the spacing between pins 50, 56 is approximately 0.4 cm, and the width of rib 42 is approximately 0.4 cm.

As shown in FIG. 1, tubular member 18 has a substantially L-shaped profile comprising a body 74 and an arm 76, the length of body 74 is approximately 70 cm and the length of arm 76 is approximately 15 cm. The length of tubular member 16 is approximately 60 cm. Pin 56 is located approximately 1.5 cm from the end of body 74. Telescopic body 20 is fabricated by placing guide 70 onto the end of body 74. Guide 70 is then rotated until slot 72 and pins 50, 56 are aligned. Next, guide 70 is pushed upwardly until it is positioned between pins 50 and 56. Next, guide 70 is rotated approximately one quarter of a turn. Next, the assemblage of tubular member 18 and guide 70 is inserted into tubular member 16 with slot 72 straddling rib 42. Next, fabric washer 40 and cap 36 are placed on arm 76 and pushed into contact with the upper end of tubular member 18. Finally, cap 36 is turned onto threaded end of tubular member 16. Tubular member 18 is vertically and rotatably adjustable within tubular member 16. Fabric washer 40, composed of felt for example, is operative to maintain coaxial alignment of tubular members 16 and 18 and to prevent scratching of tubular member 18 when it is adjusted relative to tubular member 16. For vertical adjustment, tubular member 18 is pulled either upwardly or downwardly, guide 70 provides sufficient frictional force between tubular members 16 and 18 to prevent free movement of tubular member 18 and insufficient frictional force to prevent forced movement. Upward vertical movement of tubular member 18 is limited by pin 50 contacting fabric washer 40. Tubular member 18 is rotatable within tubular member 16 for less than one revolution. As tubular member 18 is rotated, pins 50 and 56 engage rib 42 and rotational movement is stopped. Guide 70 is operative to maintain tubular members 16 and 18 in axial alignment. From the foregoing, it will be appreciated that the assemblage of tubular member 18 having projecting pins 50, 56; guide 70 and tubular member 16 having longitudinal rib 42 is such that tubular member 18 is vertically adjustable relative to tubular member 16 and tubular member 18 is rotatably movable less than one complete revolution relative to tubular member 16, guide 70 held between pins 50 and 56.

Figure 6:
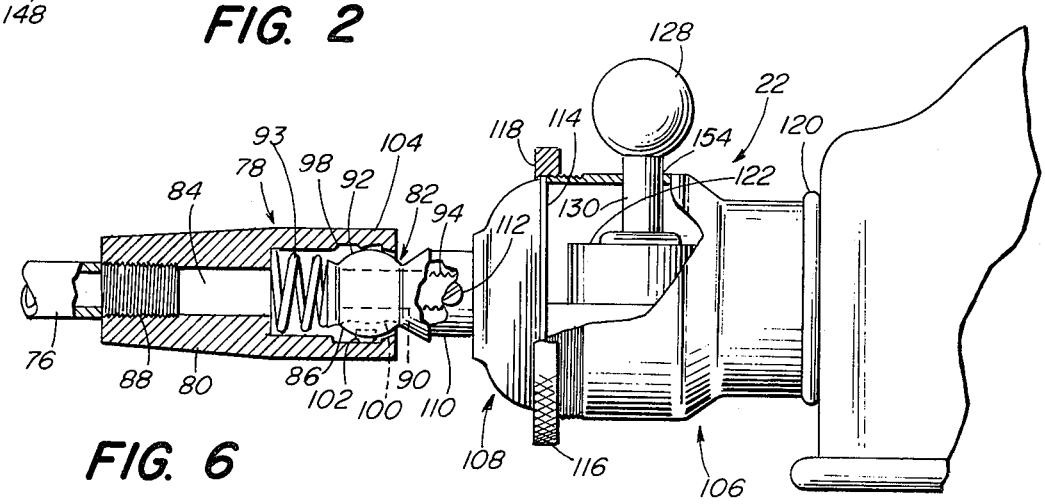
FIG. 6 is a fragmentary perspective, partly in section, showing the lamp receptacle and its connecting member.

The free end of tubular member 18 at arm 76 is externally threaded and a ball and socket fixture 78 of the type shown in U.S. Pat. No. 3,186,736 is turned thereon. As best shown in FIG. 6, ball and socket fixture 78 comprises a socket 80 and a ball 82. Socket 80 is formed with an axial bore 84 that is enlarged at an end 86 and internally threaded at an opposite end 88. The threaded end of socket 80 is turned onto arm 76. Ball 82 has an axial bore 90 and a spherically shaped head 92 terminating in a threaded portion 94. Head 92 is captively held in bore 84 at end 86 by means of a spring 93. Ball 82 is mounted in socket 80 for angular and rotary movement within axial bore 84 at enlarged end 86. Axial bores 84 and 90 are in continuity and define a passage for a power cord 96. Socket 80 is formed with an internal track 98 and ball 82 is formed with an axial groove 100 which intersects track 98. A pin 102 extends across the intersection of track 98 and groove 100, pin 102 having an axis in radial alignment with respect to head 92. Rotary movement of ball 82 within socket 80 is limited by a depression 104 which defines an obstruction into track 98 that engages pin 102 and limits rotation of head 92 to less than one revolution. Receptacle 22 is turned onto threaded end 94 of ball 82.

Receptacle 22 includes a forward section 106 and a rearward section 108. Rearward section 108 is formed with an internally threaded annular flange 110 which is adapted to receive threaded end 94 of ball 82. A fastener 112, for example a set screw, is turned into a threaded hole in flange 110 and engages threaded end 94, whereby receptacle 22 is secured to fixture 78. The forward end of rearward section 108 is provided with an annular rib 114 and the rearward end of forward section 106 is externally threaded. An internally threaded ring 116 having a rearward annular shoulder portion 118 adapted to engage rib 114 is turned onto the externally threaded rearward end of forward section 106. In consequence, forward section 106 and rearward section 108 are fastened together by ring 116. The forward end of forward section 106 is externally threaded and is adapted to receive an internally threaded flange 120 of shade 24, for example a dome shaped shade. Mounted within forward section 106 is a variable intensity control 122.

Referring now to the schematic diagram illustrated in FIG. 7, it will be seen that variable intensity control 122 concludes a variable impedance 124, for example, a potentiometer having a wiper arm 126 which is operatively connected to a control knob 128 via an insulating rod 130. Knob 128 is connected also to the contact arm of a switch 132. One side of potentiometer 124 is connected to a lead 134 of power cord 96 and a terminal 136 of switch 132 is connected to a lead 138 of power cord 96. A terminal 140 of switch 132 is connected to a terminal 142 of a socket 144 and the other side of potentiometer 124. Wiper arm 126 is connected to a terminal 146 of socket 144. Power cord 96 is threaded successively through ball and socket fixture 78 and telescopic body 22 and exists from lamp 10 through an aperture 148 in base 12 which is fitted with an annular bushing 150 composed of a linear polyamide resin, for example. As shown in FIG. 1, a line plug 151 is attached to the free end of power cord 96. Socket 144 is adapted to receive an incandescent lamp 152, forward section 106 being formed with an aperture 154 through which insulating rod 130 projects. The intensity of the luminance emitted from lamp 152 is governed by the position of wiper arm 126 which is controlled by the rotation of knob 128. By way of example, when knob 128 is rotated to its most counter-clockwise position the intensity of the luminance emitted from lamp 152 is greatest, and when knob 128 is rotated to its most clockwise position the contact between terminals 136 and 140 is broken and lamp 152 is off.

It is preferred that base 12, telescopic body 20, ball and socket fixture 78, receptacle 22 and shade 24 are composed of a metal such as brass, for example, and guide 70 and insulating rod 89 are composed of a plastic such as a linear polyamide resin.

From the foregoing it will be appreciated that the present invention provides a floor lamp having a telescopic body that is vertically and rotatably adjustable and a lamp receptacle that is angularly and rotatably adjustable in a ball and socket fixture. The rotatable movement provided by the telescopic body and the rotatable movement provided by the ball and socket fixture are limited to less than one complete revolution.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A multiple position lamp comprising:

a. a base;

b. telescopic body means mounted to said base, said body means including at least first and second tubular members, said first tubular member fixed to said base, said first tubular member formed with a longitudinal rib on an interior surface thereof, said second tubular member telescopically received within said first tubular member, said second tubular member vertically and rotatably movable relative to said first tubular member, a pair of stops in spaced parallel alignment extend from an exterior surface of said second tubular member towards an interior surface of said first tubular member, said stops out of contact with the interior surface of said first tubular member, a guide formed with a longitudinal slot disposed about said second tubular member between said stops, said rib received in said slot, said stops engaging said rib to limit rotational movement of said second tubular member relative to said first tubular member to less than one revolution;

c. a receptacle adapted to receive at least one lamp; and d. means for mounting said receptacle to said second tubular member.

2. The multiple position lamp as claimed in claim 1 wherein said rib is formed by an extrusion process.

3. The multiple position lamp as claimed in claim 1 wherein said first tubular member is a sheet material that is rolled into a tubular structure, edges of said sheet material being interlocked to form said rib.

4. The multiple position lamp as claimed in claim 1 wherein said means for mounting said receptacle is a ball and socket fixture configured for angular and rotational movement of said receptacle relative to said second tubular member, said rotational movement of said receptacle limited to less than one complete revolution.

5. The multiple position lamp as claimed in claim 1 wherein said receptacle includes variable intensity means for controlling the intensity of illumination emitted by said lamp.

6. The multiple position lamp as claimed in claim 5 wherein said receptacle includes a socket having at least first and second contacts and wherein said variable intensity means includes variable impedance means and switch means, said variable impedance means including a potentiometer having a wiper arm, said switch means having at least first and second terminals, one side of said potentiometer connected to a first lead, the other side of said potentiometer connected to said first contact and said first terminal, said second terminal connected to a second lead, said first and second leads connected to a power cord, said wiper arm connected to said second contact, said switch means having engaged and disengaged positions, said first and second terminals electrically connected when said switch means is in said engaged position, said first and second terminals being electrically disconnected when said switch means is in said disengaged position, electrical power being applied to said socket when said switch means is engaged, illumination emitted from said lamp when said switch is in said engaged position, the position of said wiper arm operating to control the intensity of the illumination emitted from said lamp when said switch means is in said engaged position.

7. The multiple position lamp as claimed in claim 1 wherein said base is a weighted base having extending feet.

8. A multiple position lamp comprising:

a. a base;

b. a first tubular member, one end of said first tubular member mounted to said base, said first tubular member formed with a longitudinal rib projecting outwardly from an interior surface thereof;

c. a second tubular member having a pair of stops in spaced parallel alignment extending from an exterior surface thereof, said stops at one end of said second tubular member, said one end of said second tubular member received in said first tubular member, an annular chamber formed between said first and second tubular members;

d. a cylindrical guide formed with a longitudinal slot disposed in said chamber between said stops, said rib received in said slot;

e. said second tubular member vertically and rotatably adjustable in said first tubular member, said stops contacting said rib as said second tubular member is rotated in said first tubular member to limit said rotational movement to less than one revolution;

f. a cap mounted to the other end of said first tubular member, said cap formed with a concentric hole through which said second tubular member extends, upward vertical movement of said second tubular member relative to said first tubular member limited by one of said stops contacting said cap;

g. a receptacle adapted to receive at least one lamp; and h. means for mounting said receptacle to the other end of said second tubular member.

9. The multiple position lamp as claimed in claim 8 wherein said first tubular member having said longitudinal rib is formed by an extrusion process.

10. The multiple position lamp as claimed in claim 9 wherein said first tubular member is a sheet material that is formed into a tubular structure, edges of said sheet material being interlocked interior of said tubular structure to form said longitudinal rib.

11. The multiple position lamp as claimed in claim 8 wherein said means for mounting said receptacle is a ball and socket fixture including a tubular socket member having an axial bore enlarged at one end, a swiveling ball member having an axial bore and a spherical shaped head terminating one end thereof, said head being movably mounted in said socket member bore enlarged end for adjustable angular and rotary movement of said ball member with respect to said socket member with said axial bores in continuity for extension of electric wiring therethrough, an internal track formed in said socket member, said spherical shaped head being formed with a generally axially extending groove intersecting said track, a pin extending across said intersection into said groove and track and having an axis in radial alignment with respect to said spherical shaped head, and a depression formed in an exterior wall portion of said tubular socket extending as an obstruction into said track for engaging said pin to limit said rotary movement to less than one complete revolution.

* * * * *